United States Patent [19]

Polgaire et al.

[11] 4,168,227

[45] Sep. 18, 1979

[54] FLOTATION METHOD FOR OXIDIZED ORES

[75] Inventors: Jean-Louis Polgaire, Nancy; Pierre Pivette, Sucy en Brie, both of France

[73] Assignee: Ceca S.A., Velizy-Villacoublay, France

[21] Appl. No.: 842,270

[22] Filed: Oct. 14, 1977

[30] Foreign Application Priority Data

Oct. 18, 1976 [FR] France ..... 76 31249

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 2,177,985 | 10/1939 | Harris | 209/166 |
| 2,214,352 | 9/1940 | Schoeller | 209/166 X |
| 3,179,250 | 4/1965 | Bunge | 209/166 |
| 3,265,211 | 8/1966 | Ray | 209/166 |
| 3,363,758 | 1/1968 | Cronberg | 209/166 |
| 3,960,715 | 6/1976 | Dicks | 209/166 |

*Primary Examiner*—Robert Halper

*Attorney, Agent, or Firm*—Stevens, Davis, Miller & Mosher

[57] ABSTRACT

In a method for enriching oxidized ores by froth flotation, use is made, as collector, of a combination comprising : at least a first compound selected among amino-l-alkane products having the general formula $R_1$ - (NH $CH_2$ $CH_2$ $CH_2$)n $NH_2$, wherein $R_1$ is a saturated or unsaturated straight- or branched-chain hydrocarbon group containing from 8 to 18 carbon atoms, and n is an integer ranging from 0 to 3, and at least a second compound selected among amino-ether products having one amino function and at least one ether function, of the general formula $R_2$ - O - ($CH_2$ $CH_2$ O)n - $CH_2$ $CH_2$ $CH_2$ $NH_2$, wherein $R_2$ is a saturated or unsaturated straight- or branched- chain hydrocarbon group containing from 2 to 18 carbon atoms, and n is an integer ranging from 0 to 2.

12 Claims, No Drawings

FLOTATION METHOD FOR OXIDIZED ORES

The invention relates to a flotation method wherein use is made, as a collector reagent for ore froth flotation, of a combination consisting of alkylamines and etheramines. Said method is more particularly usable for the flotation of ores consisting of oxidized minerals of the type so-called "oxidized ores". Froth flotation methods are in general use for enriching ores.

On this purpose, the relative ore is crushed and ground in an aqueous medium so as to form a pulp to which is added a reagent so called collector intended to be fixed on the surface of the particles which belong either to the rich ore valuable fraction or to the unwanted or gangue fraction, rendering the surface thereof hydrophobic. Said particles are subjected to a bubbling process, wherein air bubbles are fixed to the hydrophobic surface of the particles, the latter being driven at the surface of the aqueous medium as foamed material or froth. The mineral particles of certain species which did not have retained the collector, are not driven in the froth. On purpose to avoid any collector fixation on unwanted mineral species, another agent, called depressing agent, which is capable of selectively setting on the surface of the particles of said unwanted mineral species so as to avoid the setting of the collector, may be added to the pulp preliminary to any addition of collector.

Crushing is an important step of said process, said step having for its purpose to liberate the valuable species. The particle size at which said step is carried out is called liberation. The finer is the liberation size, the more elaborated is the said crushing process. In this case, the presence of very fine particles is detrimental to the flotation process and cost, due to the fact that on the one hand a great deal of reagents must be used and on the other hand the froth formed is too abundant and over-stable. Accordingly it is required to eliminate after the crushing step these fines called slimes, which consist of very fine particles of mineral species. However, said desliming step can draw to a loss of valuable species, which is detrimental to the process yield.

The froth flotation generally comprises the following steps:

crushing;

possibly desliming;

conditioning of the pulp by means of a depressing agent;

conditioning of the pulp by means of a collector agent;

air admission.

When the valuable species are set by the collector and discharged together with the froths, the flotation is a so-called direct one. When the unwanted species is discharged together with the froths, the flotation is a so-called reverse one.

In the latter case, the froths are discharged and may be cleaned, once or more, with or without addition of collector as to obtain a reject having a very low content of valuable species. The ore which is deposited on the bottom of the cells is a concentrated fraction called concentrate, which is recovered, filtered and dried. The first flotation step is called rough stage, the following ones cleaner stage. The reverse flotation process is advantageously used in the case of ores having a silicated gangue, wherein the valuable species consists of oxidized minerals associated with silica and/or silicates and/or alteration minerals. The ores of this type which can be subjected to said beneficiation process where the unwanted species are floated, include, for example, phosphate ores quartz ores and iron ores. Iron ores of the Itabirite or Taconite type are typical examples of this kind of oxidized iron ores which can, under other denominations, have different forms having closed mineralogical characteristics. Said ores consist of iron oxides such as magnetite, hematite, substantially associated with silica and possibly silicates. Besides, said ores may include alteration minerals, such as clays, limonite, geothite and the like. The presence of these species due to their fine size and/or the important specific surface thereof is detrimental to the flotation as a result of the heavy consumption of reagents, the froths being further difficult to be handled. When the ore to be treated does not include any alteration minerals and has a high liberation size, the content of fines to be discharged is substantially low, whereas when the ore to be treated includes alteration minerals and/or when the liberation mesh size is low, the substantial amount of fines must be eliminated by a desliming process, which involves a slight loss of valuable species.

It has been proposed to use, as collector, fatty acids. However, the conditions in which such acids may be used are critical and they are rather utilized on purpose to ungrade the concentrates. It has also been proposed to use acid salts and aliphatic ethers of primary amines, and products obtained from the reaction of alkylalkylene diamines with fatty acids. However, the collector which is generally recommended consists of alkylamine salts, especially alkylamine acetates. But the use of said collectors is not very satisfactory, especially when the ores either are in a very divided state or include alteration minerals.

For a better understanding of the invention hereinafter described and claimed, it is advisable to define the characteristics which permit to determine the efficiency of the collector.

The aim of a collector is to enable the gangue to be removed, while discharging a lower rate of valuable species, so as to obtain a maximum recovery with a concentrate having the highest content.

The main process statements have to be defined as follows:

the metal recovery of the concentrate which is the percentage of metal recovered in said concentrate with regard to the products which have not been subjected to a desliming step.

the metal grade of the concentrate. It is preferable to process a concentrate having both metal of the valuable species content and metal recovery as high as possible.

In case of iron ores, a concentrate of this kind can be subjected to economical metallurgical processes, the lower the silica content, the cheaper the process which must be carried out.

According to the invention, it has been discovered that it was particularly advantageous to use, as collector, a combination of:

(1) at least a first compound selected among amino-1-alkane compounds having the general formula $$R\text{—}(NH\ CH_2\ CH_2\ CH_2)n\ NH_2$$

wherein R is a saturated or unsaturated straight- or branched-chain hydrocarbon group containing from 8 to 18 carbon atoms, and n is an integer ranging from 0 to 3, (2) and at least a second compound selected among amino-ether products, i.e. those having one amino function and at least one ether function, of the general formula $$R—O—(CH_2\ CH_2\ O)n—CH_2\ CH_2\ CH_2\ NH_2$$

wherein R is a saturated or unsaturated straight- or branched-chain hydrocarbon group containing from 2 to 18 carbon atoms, and n is an integer ranging from 0 to 2.

In the following description, particularly in the examples embodying the invention, the compounds defined in aforesaid point 1 and those defined in aforesaid point 2 will be called "alkylamine" and "etheramine", as a generic denomination, respectively.

In fact, it has been found that the use of a combination of said compounds has, when composed with the use of a sole one, the following advantages:

recovery improvement;

improved grade of valuable species in the concentrate;

lowering of the unwanted species;

possibility, without any preliminary desliming, of processing finely divided ores which possibly include a very high rate of particles having a size lower than 37 microns, thus obtaining very satisfactory results without increasing the quantity of collector to be used;

improvement of the froth quality, especially in case of finely divided ores. It has further been established that in a process involving a combination of alkylamines and etheramines, the dosage of the reagents and the ore feeding rates were not critical and could be selected in substantially large ranges, respectively.

Finally, a combination of alkylamines and etheramines is substantially indifferent to hard water grade.

The alkylamine and the etheramine can be used in relative proportions or ratios ranging from 1:10 to 10:1, preferably 3:2 to 4:1, and more advantageously 7:3 for the type of ores used in the following examples embodying the invention.

In a preferred embodiment, the alkylamine and the etheramine can be used as water-soluble or -dispersable salts, the respective salt formation being performed by means of a mineral or organic acid. For economical reasons and convenience, it is advantageous to use acetic or hydrochloric acid.

The invention is described hereinafter in more detail with reference to the following examples, in which the usual consumption of the reagents, i.e. the depressing and the collector, are in grams per metric ton of processed ore before desliming.

In these examples, the term "alkylamine" is used for a fatty amine extracted from coprah, manufactured by the French Company CECA SA.

Etheramine No. 1 is an alkorypropylamine having the following configuration:

$$R—O—CH_2\ CH_2\ CH_2\ NH_2$$

which is obtained starting from a mixture of n-octanol and n-decanol by catalytic cyanoethylation and hydrogenation of the nitrile ether, manufactured and sold by the French Company CECA SA.

Etheramine No. 2 is a n-decyloxyproplamine obtained by a method similar to that for producing etheramine No. 1, starting from n-decyclic alcohol.

Etheramine No. 3 is a n-hexyloxyethoxy-propylamine obtained by a method similar to that for producing etheramine No. 1, starting from the monohexylic ether of ethylene glycol.

Etheramine No. 4 is a n-octyloxypropylamine obtained by a method similar to that for producing etheramine No. 1, starting from n-octanol.

EXAMPLE 1

An iron ore of the itabirite type is subjected to a flotation process.

The feed ore contains 51.5% of iron and 23.4% of silica. By carrying out a crushing process, one obtains a product including 85% by weight of particles having a size ranging from 53 to 178 microns. After desliming, the losses attain 6% of the feed ore, i.e. a metal loss reaching 4% of iron. The flotation is carried out from deslimed crushed ore conditioned at pH 9 with mild tapioca starch.

Use was made, as collector, of a mixture of alkylamine and etheramine No. 1. Tests have been carried out with different alkylamine-etheramine ratios, for comparison with tests involving the sole alkylamine and etheramine, respectively, but using however the same amounts of collector, i.e. 250 grams/metric ton, and of starch, i.e. 500 grams/metric ton.

The froths from the rougher are cleaned once, without addition of collector, the final concentrate consisting of both the concentration from rougher and cleaner stages.

In Table 1 are indicated:

the silica and iron contents of the final concentrate the iron and silica recovery of the final concentrates, calculated from the raw ore which has not been subjected to deliming.

TABLE 1

| | | Concentrate contents | | Concentrate recovery | |
|---|---|---|---|---|---|
| | | iron % | silica % | iron % | silica % |
| Alkylamine only | | 66.62 | 3.67 | 87.37 | 12.60 |
| Alkyl- | 4 : 1 | 67.40 | 2.54 | 91.30 | 9.97 |
| amine- | 3 : 2 | 67.26 | 2.74 | 89.91 | 10.32 |
| etheramine | 2 : 3 | 64.46 | 6.73 | 91.45 | 22.90 |
| combin- | 1 : 4 | 65.32 | 5.48 | 90.16 | 18.52 |
| ation: | | | | | |
| Etheramine only | | 59.67 | 13.24 | 90.83 | 46.13 |

From this Table it appears that the best iron contents, the slightest silica contents and the slightest silica recovery in the final concentrate are obtained with the alkylamine-etheramine combination in 4:1 and 3:2 ratios.

Besides, the iron yield in the final concentrate is improved, with respect to alkylamine, in the other tests. However, when use is made of a combination including a major proportion of etheramine, as well as etheramine only, the silica content of the concentrate is too high.

EXAMPLE 2

The same ore as in example 1 was used while applying the same conditions, except that 450 grams/metric ton of starch were used instead of 500 grams/metric ton of the same, use being made of etheramine No. 3.

The same indications as in Table 1 are given in Table 2, i.e.:

iron and silica contents in the concentrate iron and silica recovery in the concentrate, calculated from the raw ore not subjected to desliming.

TABLE 2

| | | Concentrate contents | | Concentrate recovery | |
|---|---|---|---|---|---|
| | | iron % | silica % | iron % | silica % |
| Alkylamine only | | 66.48 | 3.94 | 82.10 | 12.16 |
| Alkyl- | 4 : 1 | 65.85 | 4.85 | 72.87 | 13.32 |
| amine- | 3 : 2 | 67.56 | 2.38 | 92.99 | 9.44 |
| etheramine | 2 : 3 | 64.29 | 6.98 | 84.62 | 22.08 |
| combina- | 1 : 4 | 59.12 | 14.10 | 89.79 | 48.64 |
| ation: | | | | | |
| Etheramine only | | 53.56 | 22.61 | 91.03 | 85.29 |

From this Table it appears that the best iron content, the slightest silica content, the highest iron recovery and the slightest silica recovery are obtained with the alkylamine-etheramine combination in the 3:2 ratio.

EXAMPLE 3

The same ore as in examples 1 and 2 was used, when applying the same conditions, except that 430 grams/-metric ton of starch and 125 grams/metric ton of collector. Use is made of etheramine No. 4.

Further, the starch is treated with 25% caustic soda and use was not made of a pH adjusting agent for the flotation. The ph of the pulp ranges from 10.3 to 10.4 at the beginning of the starch conditioning step, and from 9.5 to 9.6 at the end of the collector conditioning step. For these conditioning steps, use was made of a foaming agent at the rate of 10 grams/metric ton.

The same indications as in Tables 1 and 2 are given in Table 3, i.e.:

iron and silica contents in the final concentrate iron and silica recovery in the final concentrate, calculated from a raw ore non-subjected to desliming.

TABLE 3

| | | Concentrate contents | | Concentrate recovery | |
|---|---|---|---|---|---|
| | | iron % | silica % | iron % | silica % |
| Alkylamine only | | 64.95 | 6.08 | 92.55 | 18.93 |
| Alkyl- | 4 : 1 | 66.88 | 3.29 | 83.64 | 9.80 |
| amine- | 3 : 2 | 67.15 | 2.90 | 91.44 | 10.02 |
| etheramine | 2 : 3 | 63.96 | 7.51 | 93.79 | 23.04 |
| combin- | 1 : 4 | 59.70 | 13.20 | 93.85 | 42.65 |
| ation: | | | | | |
| Etheramine only | | 55.42 | 19.42 | 94.73 | 67.12 |

From Table 3 it readily appears that the best iron content and the slightest silica content, for an iron recovery higher than 91%, are obtained with the alkylamine-etheramine combination in the 3:2 ratio.

EXAMPLE 4

The same ore as in examples 1 and 2 was used, except that said ore was not deslimed. The pulp has been conditioned with 1300 grams/metric ton of corn starch, while the froths have been cleaned again without addition of collector agent.

Two tests have been carried out. In the first test, use has been made, as collector, of 300 grams/metric ton of alkylamine. In the second test, use has been made of 300 grams/metric ton of an alkylamine-etheramine No. 2 in the 3:2 ratio. The test results are given in Table 4.

TABLE 4

| | Concentrate contents | | Concentrate recovery | |
|---|---|---|---|---|
| | iron % | silica % | iron % | silica % |
| Alkylamine | 64.56 | 6.71 | 95.31 | 22.18 |
| Alkylamine-etheramine | 65.45 | 5.42 | 93.04 | 17.81 |

TABLE 4-continued

| | Concentrate contents | | Concentrate recovery | |
|---|---|---|---|---|
| | iron % | silica % | iron % | silica % |
| combination: | | | | |

The use of the alkylamine-etheramine combination enables an improved iron content and a slighter silica content to be obtained, whereas the iron recovery is decreasing, such result being substantially balanced by the fact that the iron recovery is increased.

Further it appears that the flotation froths which have previously been subjected to the rougher and cleaner stage may easily be handled unless the presence of clay fines in the pulp. On the contrary, when use is made of the sole alkylamine, the stable froths thus obtained are very difficult to handle, and as a result the working thereof is quite impossible to be performed.

EXAMPLE 5

Another ore of the itabirite type was subjected to a flotation process, said ore also including a certain portion of goethite. The iron and silica contents of the feed ore were 39.4% by weight and 42.0% by weight respectively. The liberation size is slight and accordingly an elaborated crushing is required. After the crushing step, one obtains 90% by weight of ore particles having a size lower than 74 microns and 60% by weight of ore particles the size of which is lower than 37 microns. As any desliming would result in a very important loss, the crushed product was not subjected to said step, the froths being only cleaned without any addition of collector agent. Three tests have been performed while using the same amount of collector, i.e. 250 grams/metric ton of an alkylamine-etheramine mixture No. 1 in the 3:2 ratio, different amount of mild tapioca starch being used for each test. The results thus obtained are given in Table 5.

TABLE 5

| Starch | Iron content in the | Recovery in the concentrate | |
|---|---|---|---|
| gram/metric ton | concentrate (%) | iron % | silica % |
| 800 | 62.90 | 84.56 | 12.34 |
| 1 000 | 63.40 | 84.21 | 11.05 |
| 1 200 | 63.59 | 83.91 | 10.62 |

From this Table it appears that the results thus obtained slightly differ, whatever may be the starch concentration which is varied on a wide scale.

EXAMPLE 6

Use was made of an itibarite ore including a certain percentage of goethite. The iron and silica contents of the feed ore amount to 44.5% by weight and 34.6% by weight, respectively. After the crushing step, one obtains 93% by weight of ore particles having a size lower than 75 microns, and 65% by weight of ore particles the size of which is lower than 37 microns. Use was made of a product which has not been subjected to desliming. The froths obtained from the rougher flotation are cleaned again while adding a collector agent and the froths obtained from this new flotation step are cleaned without addition of collector agent.

Two tests have been performed while using 200 and 50 grams/metric ton of collector for the rougher stage and the first cleaner stage.

The first and second tests have been performed while using, as collector agent, alkylamine and alkyamine-etheramine No. 1 mixture in the 3:2 ratio, respectively.

The results thus obtained are given in Table 6.

TABLE 6

| | Concentrate contents | | Concentrate recovery | |
|---|---|---|---|---|
| | iron % | silicate % | iron % | silicate % |
| Alkylamine | 65.02 | 5.59 | 94.01 | 12.04 |
| Alkylamine-etheramine combination: | 66.21 | 3.86 | 93.02 | 8.96 |

When the iron yield in the concentrate is lower while using an alkylamine-etheramine combination, the iron content is, on the contrary, improved and the silica content is reduced, that is the most important feature. The froths obtained from the rougher and cleaner when using an alkylamine-etheramine combination are easier to handle than those obtained when using the sole alkylamine.

EXAMPLE 7

Use was made of the same ore as in example 6, except that the crushing was more elaborated as to obtain 95% by weight of ore particles having a size lower than 37 microns. The pulp is conditioned with 950 grams/metric ton of mild tapioca starch and with alkylamine-etheramine No. 1 combination at the rate of 250 grams/-metric ton for the rougher and of 40 grams/metric ton for the first cleaner, whereupon a second cleaner stage is performed without addition of collector. The following results have been obtained:

iron content in the concentrate: 67.26%
silica content in the concentrate: 2.30%
iron recovery in the concentrate: 92.82%
silica recovery in the concentrate: 4.08%

As compared with the previous tests, one obtained an increased iron content and a reduced silica content.

What is claimed is as follows:

1. A method for enriching oxidized ores by froth flotation, wherein use is made, as collector, of a combination comprising (1) an amino-1-alkane of the formula $$R_1—(NH\ CH_2\ CH_2\ CH_2)n\ NH_2$$

wherein $R_1$ is a saturated or unsaturated straight- or branched-chain hydrocarbon group containing from 8 to 18 carbon atoms, and n is an integer ranging from 0 to 3, and (2) a monoether-monoamine of the formula $$R—O—CH_2\ CH_2\ CH_2\ NH_2$$

wherein R is a saturated or unsaturated straight- or branched-chain hydrocarbon group containing from 2 to 18 carbon atoms, wherein the ratio of the amino-1-alkane to the monoether-monoamine ranges from 4:1 to 3:2.

2. A method as set forth in claim 1, wherein the alkylamine-etheramine combination is used in the form of water-soluble or -dispersible salts, the salt conversion step being carried out partially or completely by means of a mineral or organic acid.

3. A method as set forth in claim 1, wherein the amino-l-alkane product is a monoamine of the formula $R_1—NH_2$, $R_1$ being defined as in claim 1.

4. A method as set forth in claim 1, wherein the amino-l-alkane product is a diamine of the formula $$R_1—NH_2\ CH_2\ CH_2\ CH_2\ NH_2$$

$R_1$ being defined as in claim 1.

5. A method as set forth in claim 1, wherein the acid used for the salt conversion step is acetic acid.

6. Method as set forth in claim 1, wherein the acid use for the salt conversion step is hydrochloric acid.

7. Method as set forth in claim 1, wherein the ratio between the amino-l-alkane and the monoether-monoamine is 7:3.

8. Method as set forth in claim 1, wherein the ore is in a very finely divided state.

9. Method as set forth in claim 1, wherein the oxidized ore is an iron ore.

10. Method as set forth in claim 9, wherein the iron ore is not subjected to a desliming process.

11. A method for enriching oxidized ores by froth flotation, wherein use is made, as collector, of a combination comprising (1) an amino-l-alkane of the formula $$R_1—(NH\ CH_2\ CH_2\ CH_2)n\ NH_2$$

wherein $R_1$ is a saturated or unsaturated straight- or branched-chain hydrocarbon group containing from 8 to 18 carbon atoms, and n is an integer ranging from 0 to 3, and (2) an amino-ether of the formula $$R—O\ CH_2\ CH_2\ O\ CH_2\ CH_2\ CH_2\ NH_2$$

wherein R is a saturated or unsaturated straight- or branched-chain hydrocarbon group containing from 2 to 18 carbon atoms.

12. A method as set forth in claim 11, wherein the ratio between the amino-l-alkane and the amino-ether is about 3:2.

* * * * *